US008857666B2

(12) United States Patent
O'Keefe, Jr.

(10) Patent No.: US 8,857,666 B2
(45) **Date of Patent: *Oct. 14, 2014**

(54) WINE DISPENSING SYSTEM

(76) Inventor: Edward L. O'Keefe, Jr., Traverse City, MI (US)

( * ) Notice: Subject to any disclaimer, the term of this patent is extended or adjusted under 35 U.S.C. 154(b) by 90 days.

This patent is subject to a terminal disclaimer.

(21) Appl. No.: 13/087,746

(22) Filed: Apr. 15, 2011

(65) Prior Publication Data

US 2011/0253746 A1 Oct. 20, 2011

Related U.S. Application Data

(60) Provisional application No. 61/324,628, filed on Apr. 15, 2010, provisional application No. 61/438,503, filed on Feb. 1, 2011.

(51) Int. Cl.

| | |
|---|---|
| ***B67D 7/78*** | (2010.01) |
| ***B67D 1/08*** | (2006.01) |
| ***B67D 1/06*** | (2006.01) |
| ***B67D 1/00*** | (2006.01) |

(52) U.S. Cl.

CPC .... *B67D 1/0005* (2013.01); *B67D 2210/00091* (2013.01); *B67D 1/0857* (2013.01); *B67D 2210/00133* (2013.01); *B67D 2210/00031* (2013.01); *B67D 1/06* (2013.01); *B67D 1/0888* (2013.01); *B67D 2001/0827* (2013.01); *B67D 1/0885* (2013.01); *B67D 2210/00099* (2013.01)

USPC ..... 222/132; 222/14; 222/30; 222/36; 222/37; 222/52; 222/105; 222/144.5

(58) Field of Classification Search

CPC .... B67D 1/0005; B67D 1/108; B67D 1/0004; B67D 2001/0827; G01F 11/125

USPC ..... 222/132, 135, 144.5, 146.6, 173, 23, 222/325–327, 101, 105, 214, 14, 30, 36, 37, 222/52; 417/474–476, 477.12, 480, 412

See application file for complete search history.

(56) References Cited

U.S. PATENT DOCUMENTS

| | | | | | |
|---|---|---|---|---|---|
| 2,668,637 | A | * | 2/1954 | Gilmore | 222/95 |
| 3,597,124 | A | * | 8/1971 | Adams | 417/477.11 |
| 3,750,908 | A | * | 8/1973 | Bauerlein et al. | 222/80 |
| 3,827,467 | A | * | 8/1974 | Henley et al. | 141/104 |
| 3,940,019 | A | * | 2/1976 | Kross et al. | 222/30 |
| 4,142,845 | A | * | 3/1979 | Lepp et al. | 417/477.8 |
| 4,179,249 | A | * | 12/1979 | Guttmann | 417/477.11 |
| 4,334,640 | A | * | 6/1982 | van Overbruggen et al. | 222/207 |
| 4,433,795 | A | * | 2/1984 | Maiefski et al. | 222/14 |
| 4,477,003 | A | * | 10/1984 | Baker et al. | 222/642 |
| 4,559,040 | A | * | 12/1985 | Horres et al. | 604/153 |
| 4,628,974 | A | * | 12/1986 | Meyer | 141/129 |
| 4,708,266 | A | * | 11/1987 | Rudick | 222/105 |
| 4,717,047 | A | * | 1/1988 | van Overbruggen et al. | 222/207 |
| 4,776,495 | A | * | 10/1988 | Vignot | 222/207 |

(Continued)

*Primary Examiner* — Paul R Durand
*Assistant Examiner* — Randall Gruby
(74) *Attorney, Agent, or Firm* — Feldman Gale, P.A.; Gregory L. Hillyer; A. Robert Weaver

(57) ABSTRACT

A wine dispensing system comprises a cabinet with refrigerated compartments for maintaining bulk wine in boxes and dispenses any one of a number of wine varieties upon pressing an appropriate button. Check valves in the system prevent air from spoiling unused wine, and a computer measures each pour, updates inventory, and accepts demographic information to assist in marketing and sales promotion.

18 Claims, 11 Drawing Sheets

(56) References Cited

U.S. PATENT DOCUMENTS

| | | | | | |
|---|---|---|---|---|---|
| 4,779,761 | A * | 10/1988 | Rudick et al. | 222/1 |
| 4,961,533 | A * | 10/1990 | Teller et al. | 177/25.19 |
| 5,067,636 | A * | 11/1991 | Pfeiffer et al. | 222/105 |
| 5,114,045 | A * | 5/1992 | Herpe | 222/105 |
| 5,199,604 | A * | 4/1993 | Palmer et al. | 222/25 |
| 5,349,825 | A * | 9/1994 | Duke et al. | 62/69 |
| 5,564,601 | A * | 10/1996 | Cleland et al. | 222/129.1 |
| 5,803,317 | A * | 9/1998 | Wheeler | 222/214 |
| 6,003,733 | A * | 12/1999 | Wheeler | 222/146.5 |
| 6,012,611 | A * | 1/2000 | Schroeder | 222/105 |
| 6,142,340 | A * | 11/2000 | Watanabe et al. | 222/66 |
| 6,155,465 | A * | 12/2000 | Steiger | 222/501 |
| 6,170,707 | B1 * | 1/2001 | Wolski et al. | 222/129.1 |
| 6,419,121 | B1 * | 7/2002 | Gutierrez et al. | 222/146.5 |
| 6,419,466 | B1 * | 7/2002 | Lowe et al. | 417/477.11 |
| 6,422,422 | B1 * | 7/2002 | Forbes | 222/66 |
| 6,443,335 | B1 * | 9/2002 | Pinedjian et al. | 222/504 |
| 6,561,386 | B1 * | 5/2003 | Martens | 222/105 |
| 6,607,100 | B2 * | 8/2003 | Phelps et al. | 222/152 |
| 6,607,105 | B2 * | 8/2003 | Phelps et al. | 222/400.8 |
| 6,698,621 | B2 * | 3/2004 | Landers et al. | 222/129.1 |
| D491,580 | S * | 6/2004 | Stoddart | D15/79 |
| 6,913,167 | B2 * | 7/2005 | Phelps et al. | 222/152 |
| 6,938,801 | B1 * | 9/2005 | Reddy et al. | 222/214 |
| 7,076,966 | B2 * | 7/2006 | Mullen | 62/337 |
| 7,147,134 | B2 * | 12/2006 | Gutierrez et al. | 222/146.1 |
| 7,278,553 | B2 * | 10/2007 | Py et al. | 222/207 |
| 7,356,381 | B2 * | 4/2008 | Crisp, III | 700/242 |
| 7,439,859 | B2 * | 10/2008 | Humphrey | 340/572.1 |
| 7,555,980 | B2 * | 7/2009 | Howard et al. | 99/407 |
| 7,651,010 | B2 * | 1/2010 | Orzech et al. | 222/214 |
| 7,712,631 | B2 * | 5/2010 | Taradalsky et al. | 222/1 |
| 7,762,431 | B1 * | 7/2010 | Tuyls et al. | 222/146.6 |
| 7,768,396 | B2 * | 8/2010 | Teller | 340/540 |
| 7,779,099 | B2 * | 8/2010 | Raghunathan et al. | 709/223 |
| 7,878,370 | B2 * | 2/2011 | Sevcik et al. | 222/1 |
| 8,550,310 | B2 * | 10/2013 | Alstad et al. | 222/214 |
| 2003/0098314 | A1 * | 5/2003 | Phelps et al. | 222/1 |
| 2003/0213814 | A1 * | 11/2003 | Phelps et al. | 222/146.6 |
| 2006/0009610 | A1 * | 1/2006 | Hayes | 528/272 |
| 2006/0037969 | A1 * | 2/2006 | Jennings et al. | 222/129.1 |
| 2006/0118581 | A1 * | 6/2006 | Clark | 222/333 |
| 2007/0181602 | A1 * | 8/2007 | Taradalsky | 222/152 |
| 2007/0210155 | A1 * | 9/2007 | Swartz et al. | 235/383 |
| 2007/0228068 | A1 * | 10/2007 | Schneider et al. | 222/1 |
| 2007/0233567 | A1 * | 10/2007 | Daly | 705/14 |
| 2008/0054015 | A1 * | 3/2008 | Moezidis | 222/1 |
| 2009/0040050 | A1 * | 2/2009 | Humphrey | 340/572.8 |
| 2009/0159612 | A1 * | 6/2009 | Beavis et al. | 222/52 |
| 2009/0236361 | A1 * | 9/2009 | Doelman et al. | 222/1 |
| 2009/0276088 | A1 * | 11/2009 | Ruddy | 700/232 |
| 2010/0116842 | A1 * | 5/2010 | Hecht et al. | 222/1 |
| 2010/0170916 | A1 * | 7/2010 | Segers | 222/1 |
| 2010/0176147 | A1 * | 7/2010 | Segers | 222/1 |
| 2010/0206400 | A2 | 8/2010 | Winkler et al. | |
| 2010/0276452 | A1 * | 11/2010 | Vesborg et al. | 222/144.5 |
| 2011/0011888 | A2 * | 1/2011 | Beavis et al. | 222/52 |
| 2011/0017776 | A1 * | 1/2011 | Metropulos et al. | 222/129.1 |
| 2011/0024463 | A1 * | 2/2011 | Py et al. | 222/212 |
| 2011/0100049 | A1 * | 5/2011 | Bax | 62/396 |
| 2011/0315711 | A1 * | 12/2011 | Hecht et al. | 222/129.1 |
| 2012/0055954 | A1 * | 3/2012 | Hecht | 222/129.1 |
| 2012/0258227 | A1 * | 10/2012 | Kadyk et al. | 426/524 |
| 2014/0114469 | A1 * | 4/2014 | Givens et al. | 700/232 |

* cited by examiner

WINE DISPENSING SYSTEM

CROSS-REFERENCE TO RELATED APPLICATIONS

This application claims priority to the following Provisional Application No. 61/324,628, filed Apr. 15, 2010, and Provisional Application No. 61/438,503, filed Feb. 1, 2011, which are incorporated herein by reference in their entirety.

FIELD OF THE INVENTION

The present invention relates to systems for dispensing wine by the glass or carafe from flexible, collapsible containers while maintaining accurate inventory control and pouring accuracy while minimizing product spoilage and theft.

BACKGROUND OF THE INVENTION

The traditional way of dispensing wine is by the bottle. It is also desirable to be able to sell wine by the glass. This is difficult when wine is packaged in bottles only, because wine is notoriously susceptible to oxygen degradation over a very short period of time. Thus, if a glass of wine is purchased by a buyer, the rest of the bottle will have to be thrown away if it is not consumed in a relatively short period of time of a few hours. The packaging for wine in bottles also presents a substantial cost.

There have been some developments in apparatus for prolonging the life of a bottle of wine when the wine is served by the glass. In one method, wine is served by the bottle, but the bottles are purged with nitrogen or another non-oxygen gas. These systems provide an extended life of the wine, but generally not more than a few weeks.

Another problem with dispensing wine by the glass is that it is difficult to control the quantity of wine poured in each glass and make the pourings consistent. Theft and other misuse of the wine is also difficult to track.

An object of the present invention is to provide an improved system for providing wine by the glass where quantities are accurate, wine quality is preserved, and accurate records maintained.

Another object of the present invention is to provide a system that will prevent wine from being spoiled by oxygen by using check valves and oxygen non-permeable containers to prevent oxygen from entering the wine containers.

SUMMARY OF THE INVENTION

The wine dispensing cabinet of this invention has a number of dispensing taps that dispense a number of different wines from either of two refrigerated compartments. In the preferred embodiment, up to eight wines can be maintained in the cabinet and dispensed from individual nozzles. The cabinets are independently temperature-adjustable, and white wines that are typically served at colder temperatures can be maintained at an appropriate temperature in one of the compartments while red wines can be maintained at a higher temperature in the other compartment. Thus, in a preferred embodiment, eight taps dispense varietal wines including merlot, chardonnay, riesling, cabernet sauvignon, pinot grigio, sauvignon blanc, pinot noir and zinfandel at recommended temperatures.

The wines are provided to the cabinet in plastic oxygen non-permeable bags enclosed in boxes. Each wine carton is one-third the size of a case of wine in bottles and is approximately half the weight. (Each box weighs approximately 20 pounds compared to a case of bottled wine, which weighs approximately 40 pounds). A spout extends from each bag to a connection fixture at the front of the box, and a connecting tube having a one-way check valve carries wine from the refrigerated compartment to a pump, where portions are measured, recorded, and dispensed to one of the taps. The cabinet uses one or more pumps, and in the preferred embodiment is configured to use a separate pump for each tap. The quantity of wine dispensed can be determined by using a flow meter for each hose, or a single flow meter attached to a single pump; or the quantity can be determined by timing the flow where a constant-flow pump is used. In one embodiment, the dispenser features electronic, automatic portion control: It measures accurate pours of wine in three programmable amounts and records the total ounces poured in each brand of wine for each day as well as the times of each pour.

Wine from the wine boxes is delivered to the pumps through delivery hoses that are connected to internal hoses that have check valves in the hardware connecting them. Check valves are used to prevent the backflow of wine through the hoses and to prohibit the introduction of air (oxygen) into the lines when they are being attached or detached.

A bar code is affixed to each box or its label. The bar code has a large capacity for information, and may include the amount of wine contained in the box, the brand and type of wine contained in the box, the identification of each box and the date it is tapped. The bar code can be read by a bar-code scanner that may be detachable or may be built into the wine dispensing cabinet. The wine box then is placed in slot 1 through 8 in the machine. When a new box is placed into a specific slot, a sensor registers the location of the box in the machine and reports that information to a computer, described in greater detail below. The position of the box on the shelf correlates to a specific pump, which will track how much wine is drawn from that box. Thus, the computer identifies the box and its contents when the bar code is scanned, and then the computer identifies the box's location in the machine via the sensor. This knowledge allows the machine to track each pour from each box via the data processor as the box is drained. If the box should be removed and replaced in a different slot in the compartment, the sensor will alert the computer to the new location, and information regarding that box will be maintained and updated.

A computer may be included in the wine dispensing cabinet. Where this is done, the computer can be used to perform a variety of functions including: scanning barcodes on wine boxes to determine the type of wine, the supplier, the cost, or other information relevant to the type of wine; recording the amount of wine dispensed from each box; recording and making adjustments to inventory on a daily, weekly, or monthly basis; providing notification when any of the wines need to be restocked; receiving and recording information about customers, such as scanning drivers' licenses and determining the demographics of wine consumption cross-referenced with any of a number of demographic parameters; auditing usage and wastage; and any other information relevant to wine supply and consumption. Daily, weekly and monthly inventories of each brand poured can be determined which pinpoint the most popular brands or varieties poured each day, week or month. Such reports show how many ounces have been poured and compares that data with the wine remaining, providing an accurate, on-time inventory for use by management. The computer stores information obtained from each box's bar code and from the flow meter assigned to each box. The processor allows a direct PC interface via a cable or through a modem, which can transmit information to an on-premises computer or an off-premises system.

The dispenser's computer system utilizes a flow calculation system to monitor the volume of wine the machine dispenses and can be configured to produce cumulative and on-time sales reports by brand and volume.

When the box is removed, the machine registers its removal and remembers the amount of wine remaining in that box. A partially drained box may be re-scanned and again placed in the machine as much as a year later. When the box is re-scanned, the machine will identify it and remember which slot it originally was in. The computer will also recall how much wine the box should hold when it is replaced in the dispenser. If the box contains a different amount of wine than the computer remembers, the computer will report that information in the daily printout, which will apprise management that someone may have tampered with the box.

An optional driver's license scanner scans the face of a driver's license and captures demographic information, including name, age, sex and address. The information is uploaded to a fully customizable, multifunctional database that allows the operator to track consumption according to this information. This data allows the operator to identify and capitalize on customers' preferences. The system features a fully customizable, multifunctional database that includes easy sorting of data, advanced search options and easy data export. The search option allows users to filter data by any field, including name, address, sex and birth date. This information is uploaded to the computer system, where it can be analyzed according to the brand and variety poured for each customer, allowing the user to track popular brands and varieties of wine according to age, sex, address, and other point-of-sale (POS) information.

The computer may send POS information through a modem to off-premises locations as well as supplying information to the on-site computer. In this manner, the invention provides effective bar controls, prevents theft, and manages a large wine inventory without increasing the load on the management team.

The computer can also be programmed either to shut off pouring or indicate in the daily report when a box has been tampered with. The shut-off is the machine's default response to a box that contains less wine than it should. During normal operation, a box of wine is scanned by barcode and placed on the shelf. The machine, through its sensors, knows where in the machine the box is placed and tracks how much wine is removed from the box. The operator can remove and then re-scan and replace the box in any of the eight locations. The machine picks up exactly where it left off the last time it saw that particular box. If the total volume from that box is less than the recorded volume that's in the computer (with some margin), the machine can be programmed to shut off that pumping station. This is a programmable feature and the machine can respond in any number of ways to this situation. The owner may not desire a stoppage and instead it may only log the disparity in the daily report and continue dispensing.

The computer may also be configured to allow for customer self-serve operations. In one embodiment, a credit card reader is provided which allows patrons to purchase a glass of wine from the wine dispenser and serve themselves. This eliminates the necessity of a staff member running the machine.

The dispensing cart is easily movable, having at least 4 swivel rollers and a 360-degree turn radius, and is suitable for use in hotels and other semi-public facilities. The cabinet is constructed of commercial stainless steel and features a high-visibility, full-width display of available wines in their bottles, allowing customers to view potential selections prior to ordering.

The wine dispensing system can be operated from an external electrical power supply or using an optional rechargeable lithium battery. The unit can operate on battery power with the exception of the refrigerators, which will maintain temperature without power for approximately 3 hours. Thereafter, the operator only must plug the unit in to restore temperature or replace the wine with pre-chilled boxes. The dispenser can hold 8 cases of wine at one time, ensuring that additional chilled storage rarely is needed.

The wine dispensing machine of this invention enables customers to create their own wine blends in states that allow it. In this embodiment, customers would purchase re-usable glass bottles that are sandblasted with a proprietary, universal, pre-approved label, an individual's label or a winery's existing label. The wine bar provides a variety of wines and the necessary accoutrements for blending. Customers can create their own blends, and can record the percentages of each brand and variety. When the customer is satisfied with his or her blend, the percentage of each wine variety used can be recorded by the computer, where it will be kept on file for future bottling purposes. The system blends the customer's recipe and bottles it, then places the bottles into a 6-bottle wine carrier. The blending feature of the invention is suitable for use by individual customers, by restaurants, or by wine distributors or wholesalers.

Foreign wineries that wish to export their product to the United States have a difficult time obtaining representation. They first must convince a federal importer to import wine in the hopes a state importer and wholesaler will buy it and are able to sell it to a retailer. Small wineries don't interest wholesalers, who are interested in volume. Furthermore, the foreign winery must obtain federal and state label approval in accordance with TTB and state liquor control requirements. The foreign winery then must produce the wine, bottle the wine, label the wine and ship cases of the wine to the United States before they have a sale. Small foreign wineries are faced with a huge expense if the wine is not accepted by state importers, wholesalers or retailers. Smaller wineries cannot afford this risk. As a result, many small estates are hindered from entering the U.S. market. Additionally, both the small and larger wineries face uncertainty as to how their wines will be accepted in the U.S. market. The wine dispenser of the present invention solves this problem. The exporting winery must produce only a few containers of wine, and can ship it to a U.S. seller bearing a pre-approved universal label. The wholesaler can obtain the wines directly from Emerald's importer division, and then take the boxes directly to its proposed customers or to restaurant shows, where it can determine interest directly from restaurateurs who could place orders for the wine. The wholesaler would have all the information to make a sale—price, label, source of origin, etc. The restaurateurs would rate the wine they tasted and this information would provide the wholesaler with information regarding customer interest. Customers could taste the wines and provide their opinions to the restaurateur or retailer. These wines could be dispensed as tasting wines at no charge to the customer, saving on federal and state wine taxes. This would be done at a minimum cost to the exporting winery. This process would allow small foreign wineries to determine whether their wines are accepted in the U.S. market without incurring unnecessary expenses and risks.

DETAILED DESCRIPTION OF PREFERRED EMBODIMENTS

Figure 1:
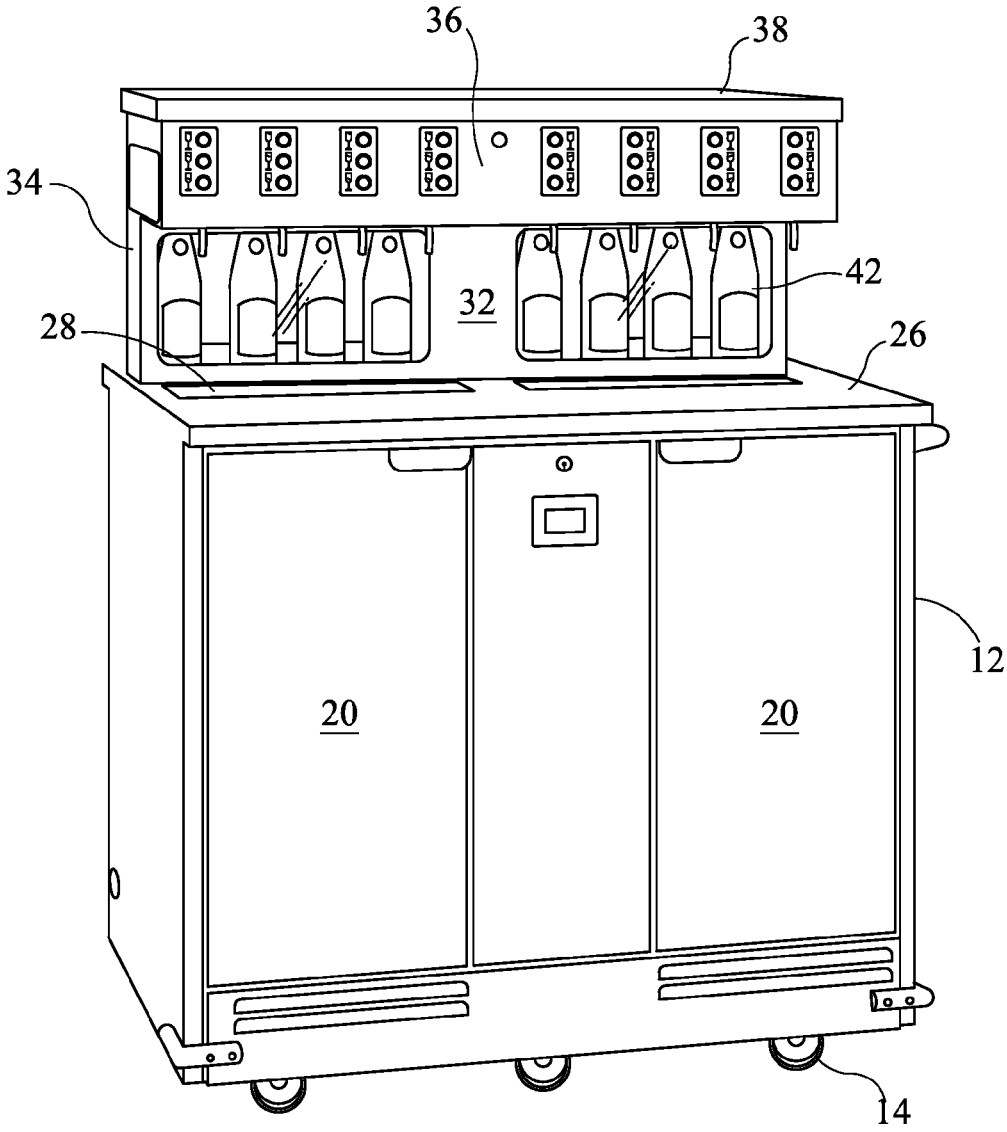
FIG. 1 is a perspective view of a wine dispenser cabinet in accordance with the present invention.
Figure 2:
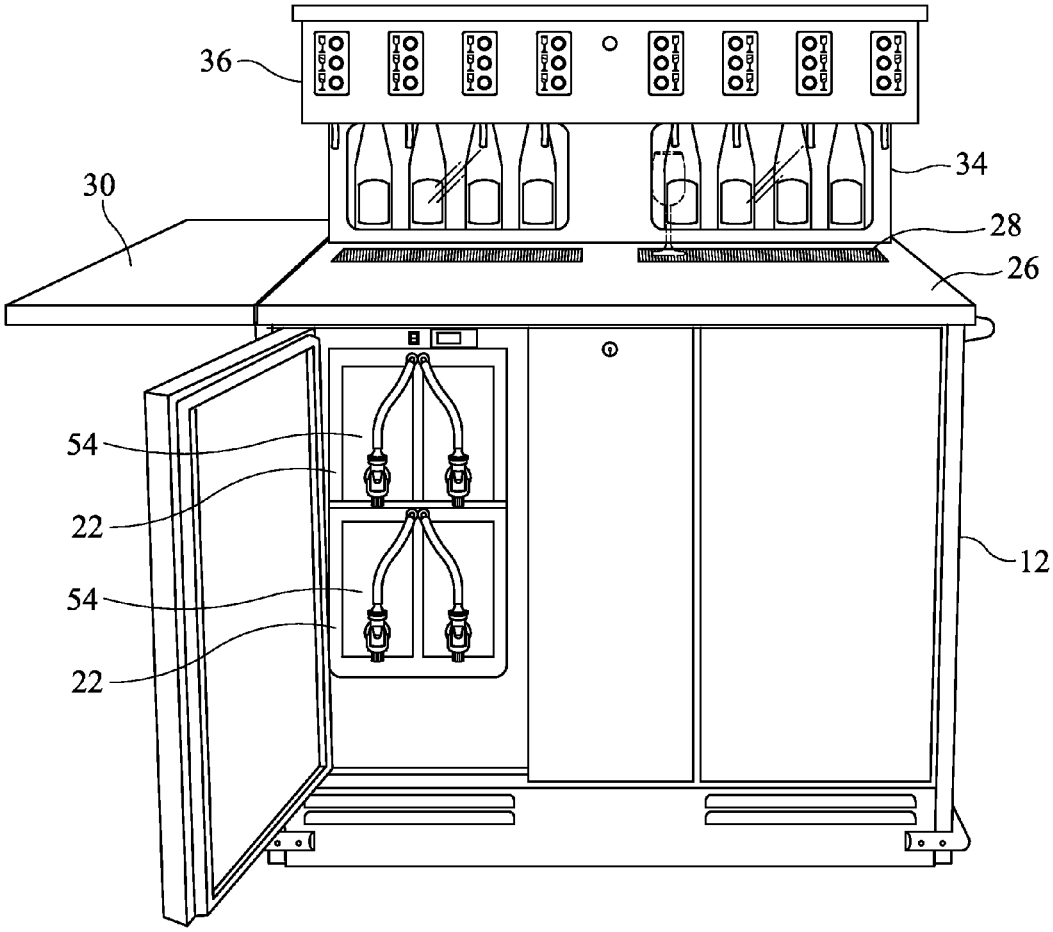
FIG. 2 is a perspective front view of the wine dispenser cabinet of FIG. 1, with one of the refrigerated compartment doors being shown in an open position.

Referring now to FIGS. 1 and 2, a wine dispenser constructed in accordance with the present invention comprises a stainless steel cabinet 12 mounted on wheels 14. The cabinet has an enclosed lower portion having an interior enclosed by hinged doors 20. The interior of the cabinet includes a number of storage receptacles 22 for retaining box wine containers 54. The interior of the cabinet also includes refrigeration equipment or other temperature control apparatus for maintaining one or more desirable temperatures in the interior of the cabinet.

The upper surface of the cabinet includes a countertop 26 at the front of the cabinet, and a drain panel 28 at the rear of the countertop for draining liquids or spillage from the counter. In one embodiment, a foldable end panel 30 is mounted on at least one side of the cabinet and can be raised to a horizontal position, as shown in FIG. 2, to serve as additional countertop surface. Alternatively, the panel can be folded downward into the side of the cabinet when not in use.

In a preferred embodiment, a wine dispensing housing is mounted on a rear portion of the cabinet and includes a vertical housing 34 extending upwardly from a rear side of the countertop and a forwardly extending dispenser housing 36 extending forwardly from the vertical housing. The vertical housing 34 serves as a display case to show bottles 42 representative of the wines being dispensed from boxes in the cabinet, with the vertical panel having a transparent panel at the front and an open interior behind the transparent panel for displaying bottles of wine.

Figure 3:
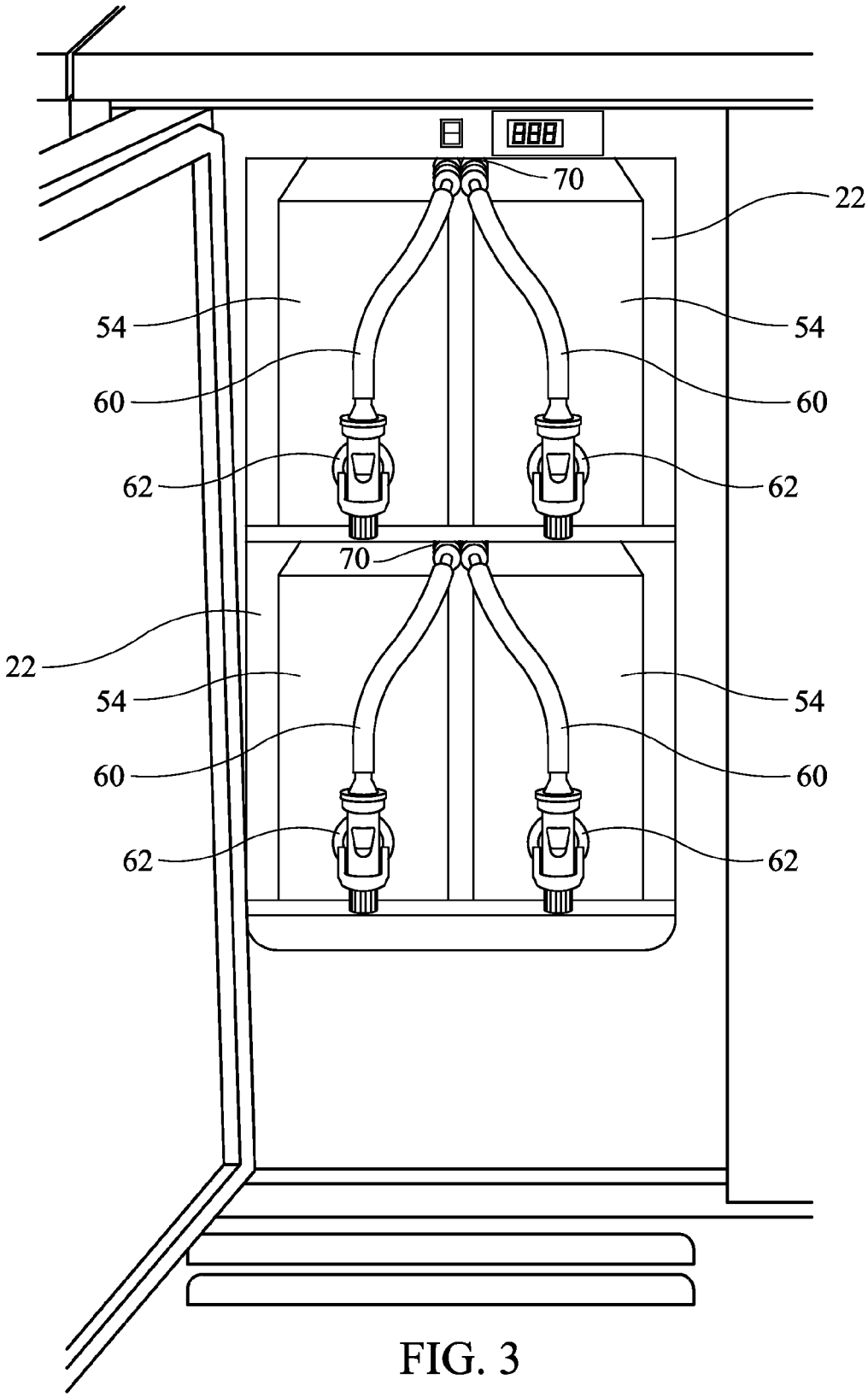
FIG. 3 is a perspective view of an open compartment of the wine cabinet of FIG. 1.

FIG. 3 shows a number of wine boxes 54 mounted in a refrigerated compartment 22 of the wine dispensing cabinet. When properly installed and connected, delivery hose 60 is attached to connector 62, and wine can be drawn from the box to the pump, and will be further dispensed into a glass. Delivery hose 60 is attached to internal hoses in the cabinet through a connector 70 that has an internal check valve. When delivery hose 60 is disconnected from the internal hosing, the check valve prevents wine from backflowing out of the connector and prevents air from entering into the cabinet hose.

Figure 4:
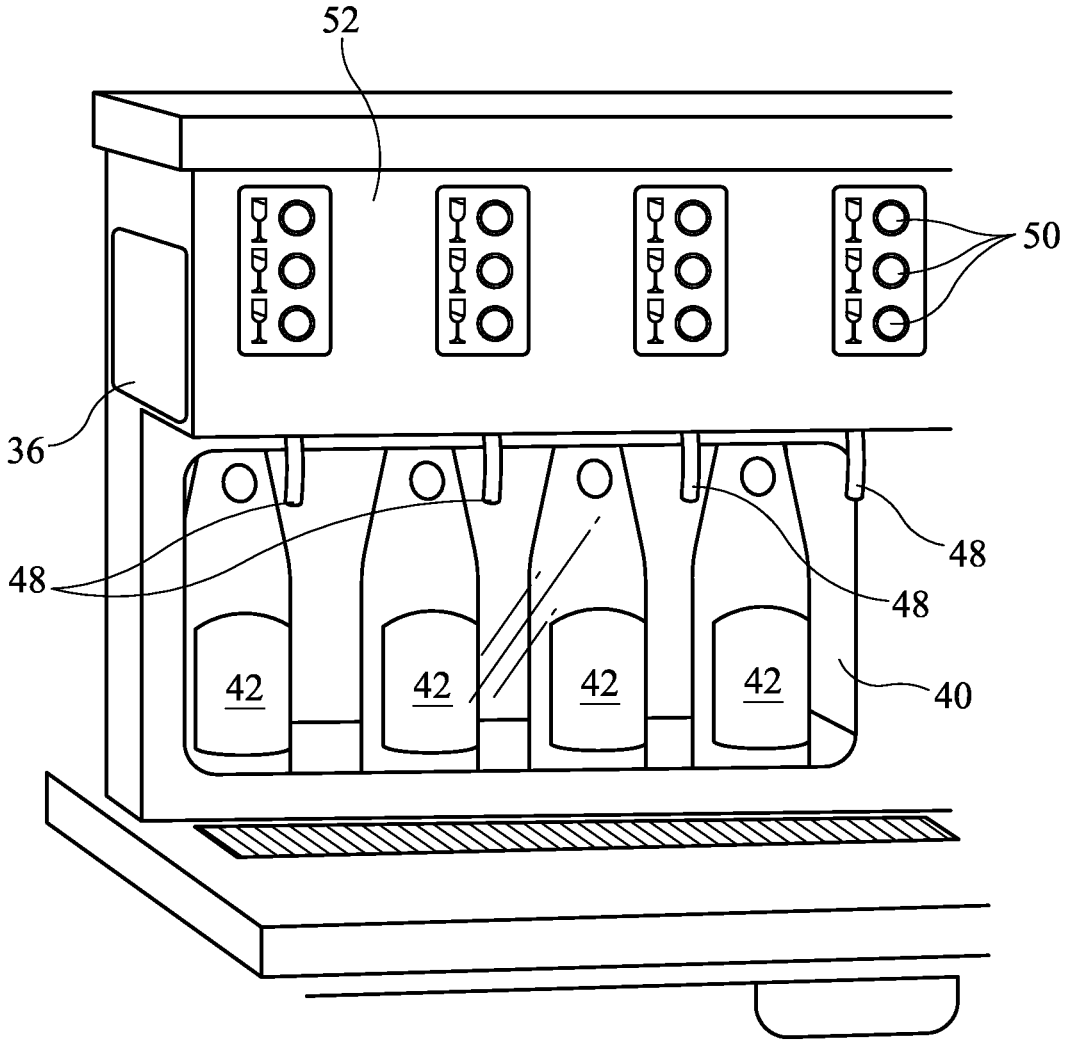
FIG. 4 is a perspective view of part of the front panel of the cabinet of FIG. 1.

One embodiment of the front panel 52 of the forwardly extending dispenser housing 36 is shown in FIG. 4. In a preferred embodiment, for each type of wine there are three automated choices that dispense varying quantities, namely a sample size, a normal size, and a large size. Persons of ordinary skill in the art will recognize that the number of choices and the amount of wine dispensed for each choice are not limited to those disclosed in the preferred embodiment. Also visible in FIG. 4 are the dispensing nozzles 48 from which wine is dispensed, and beneath which a wine glass will be placed to receive the wine. Representative bottles 42 are placed in a display area 40 to provide a visual indication of the kind of wine that will be dispensed from each nozzle 48.

Wine is dispensed in the present invention by button operated switches 50 mounted on a front panel 52 of the dispenser housing 36. In the preferred embodiment, the switches include three buttons that are preferably color coded and/or marked to represent different portion sizes. Each button actuates a timer that will cause the dispensing pump to operate for a precise period of time. Since the pump is a positive displacement pump, the amount of time that the pump is operated is used to precisely control the amount of liquid that is dispensed. By calibrating the pump with the time of operation, a precise pour amount can be determined for each operating button.

Operating buttons 50 can be programmed to operate for a predetermined period of time when depressed momentarily, or can be programmed to dispense in other ways. For example, the system could require that the button be continuously depressed to continue dispensing. This might prevent inadvertent spills. Alternatively, the system could provide for termination of an automatic pouring sequence by depressing multiple buttons simultaneously, for example.

In the illustrated embodiment, three separate buttons 50 are provided for each dispensing station. One button might be for a sample pour. Another might be for a one-half pour, and the other might be for a full pour. The number of ounces in each pour can be determined precisely, so that no overpouring or underpouring is done.

While a timed pump cycle is effective in controlling the portions poured, other portion control measures are known and could be employed. For example, a digital flow control mechanism responsive to the flow of liquid through a delivery tube could be employed to control the operation of the dispenser. Alternatively, the flow of wine may be metered, and the system configured to stop dispensing once a predetermined quantity of wine has been dispensed.

Figure 5:
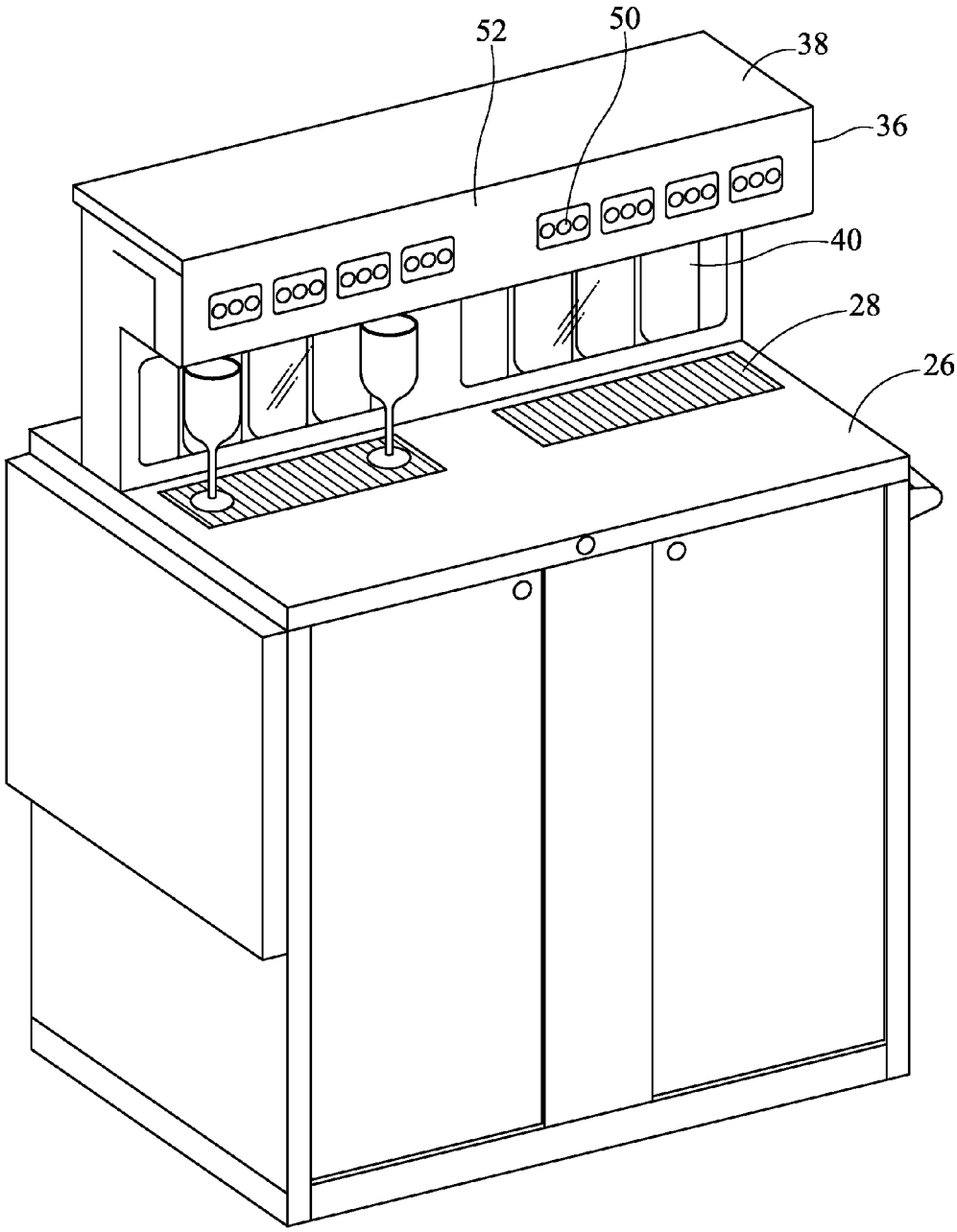
FIG. 5 is a perspective view of the wine cabinet of FIG. 1.

FIG. 5 depicts another embodiment of the front panel 52 of the forwardly extending dispenser housing 36. A top 38 may be removable, or may be hinged to allow access into the forwardly extending housing. FIG. 5 also shows a drain panel 28 built into countertop 26 whereby wine spills may be collected and cleanup can easily be performed. In this embodiment, buttons 50 on front panel 52 are arranged horizontally, rather than vertically.

Figure 6:
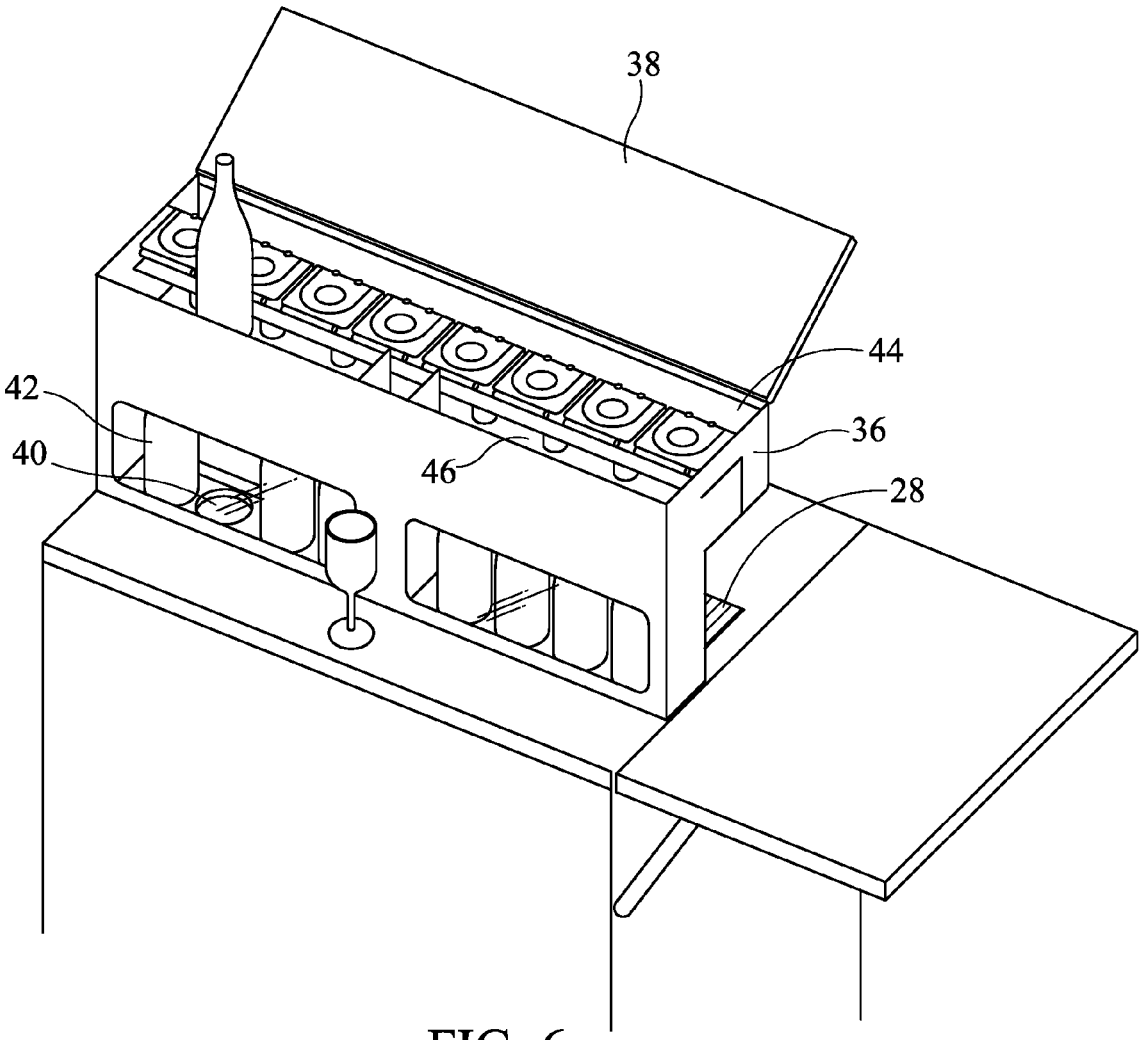
FIG. 6 is a rear perspective view of the top portion of the wine cabinet of FIG. 1, with the wine dispenser top being shown in an open position.

As shown in FIG. 6, top 38 opens to provide access to the interior of the forwardly extending vertical housing 36, so that representative wine bottles 42 can be placed into and removed from the display area 40. The interior of the front portion of dispenser housing 36 includes individual wine dispensers 44 located in the interior of the dispenser housing. Wine dispensers 44 include positive displacement pumps 46 that pump wine from each of the wine containers 54 to separate outlet nozzles 48 spaced along the underside of dispenser housing 36. Pumps 46 dispense a predictable, measured amount of liquid per unit time of operation. Thus, the amount of time the pump is operated can precisely control the amount of liquid dispensed. Such pumps are conventional. While separate pumps for each wine variety in each outlet nozzle are illustrated in the depicted embodiment of the invention, other embodiments can use a single pump, appropriately connected to the wine delivery tubes to pump the wine dispensers.

Figure 7:
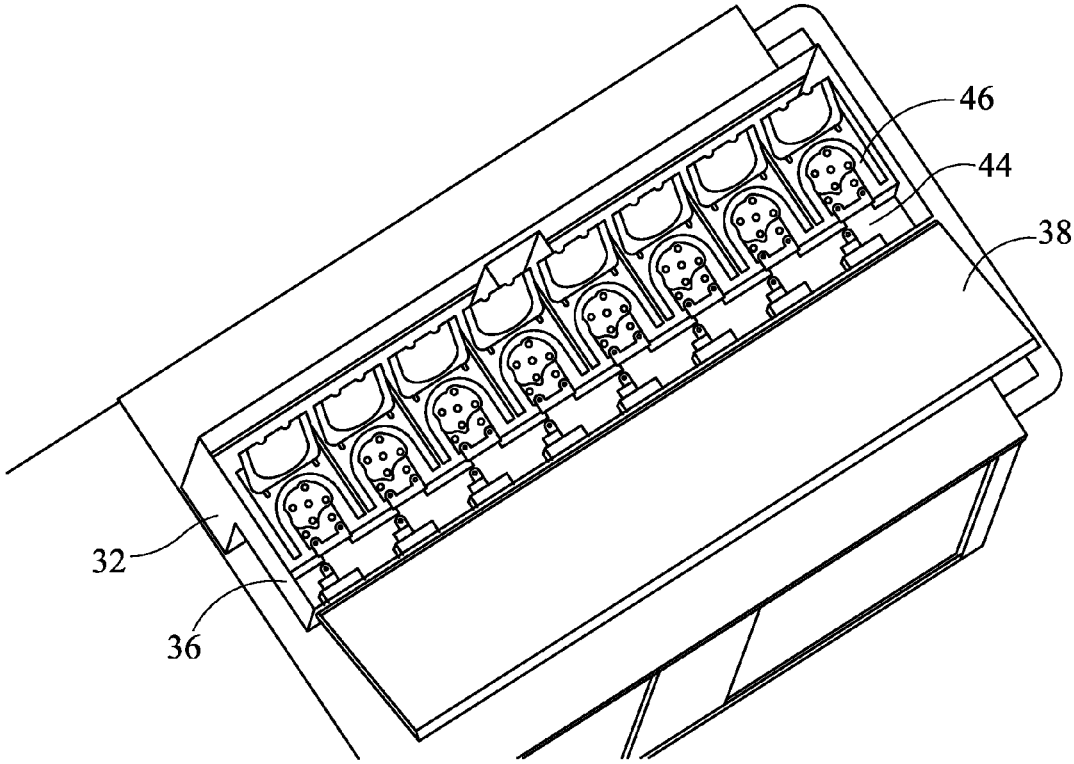
FIG. 7 is a perspective top view of the wine dispenser cabinet of FIG. 6, with the top open and showing the wine dispensers in the interior of the cabinet.

FIG. 7 depicts the interior of the forwardly extending dispenser housing 36 of the wine dispensing housing 32. Individual wine dispensing units 44 include positive displacement pumps 46 located in the interior and connected to outlet nozzles that extend downwardly through the housing. Upon being activated by the pressing of a wine selection button 50, the associated pump will begin pumping wine to the associated outlet nozzle until the desired amount of wine has been poured. Although the preferred embodiment uses positive displacement pumps that dispense a known quantity of fluid per unit of time, other pumps may be suitable for the invention, and other means for measuring quantities being dispensed may be used. In addition, a manual activation button may be used that will activate the pump for as long as the button is held down, thereby permitting the dispensing of wine in quantities other than those automatically dispensed in accordance with predetermined criteria.

Figure 8:
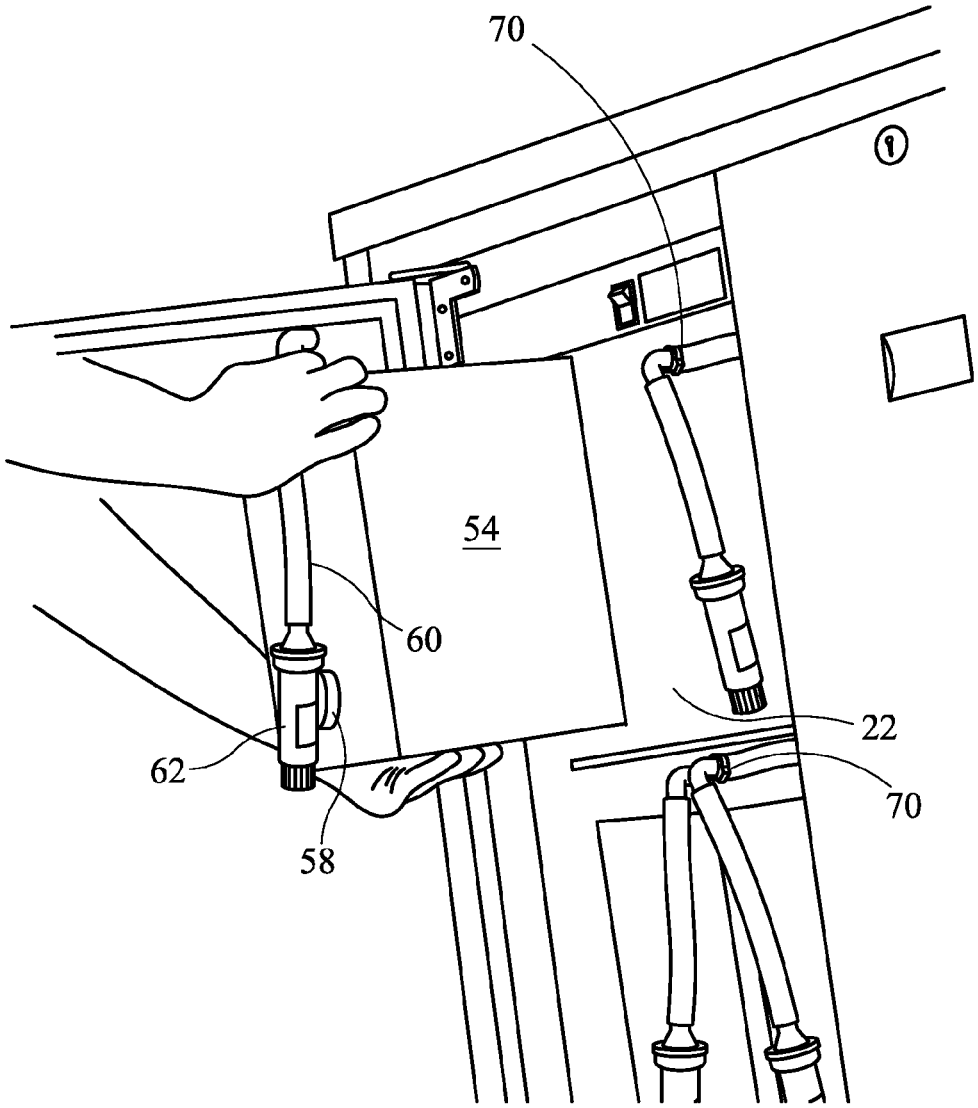
FIG. 8 is a perspective view of a wine container and outlet valve thereof with a connector for connecting the wine container to a delivery hose being shown adjacent the outlet valve.

FIG. 8 shows a wine box 54 having a wine box outlet fitting 58 that connects to delivery hose 60 with a connector 62 that interfaces with connector 58 to form a right angle connection. The wine box 54 is being inserted into a refrigerated storage receptacle 22. The wine containers 54 of the present invention include a flexible, collapsible interior container contained in a rigid shell or box. These products are known and are commonly referred to as "bag-in-a-box" containers. The advantage of these containers is that they are inexpensive, can hold up to a case of wine in one container, and will preserve the wine in a substantially oxygen free environment, so that the wine can remain fresh for up to twelve months. Conventional wine in a bottle is very susceptible to oxidation and can deteriorate substantially in a short period of hours or days.

It is known to package wine in this manner. However, the outlet valve for such containers can be problematic. In a typical bag-in-box wine container, an outlet valve mounted in the side of the container typically has a connector opening that is aligned with the interior of the container. A spigot connector or delivery tube connector typically is connected to the box outlet by pushing the connector inwardly against the side of the box. If the connector does not latch readily or if the connector is pushed too hard, the connector on the side of the box can be pushed inwardly inside the box and is thus inaccessible.

Figure 9:
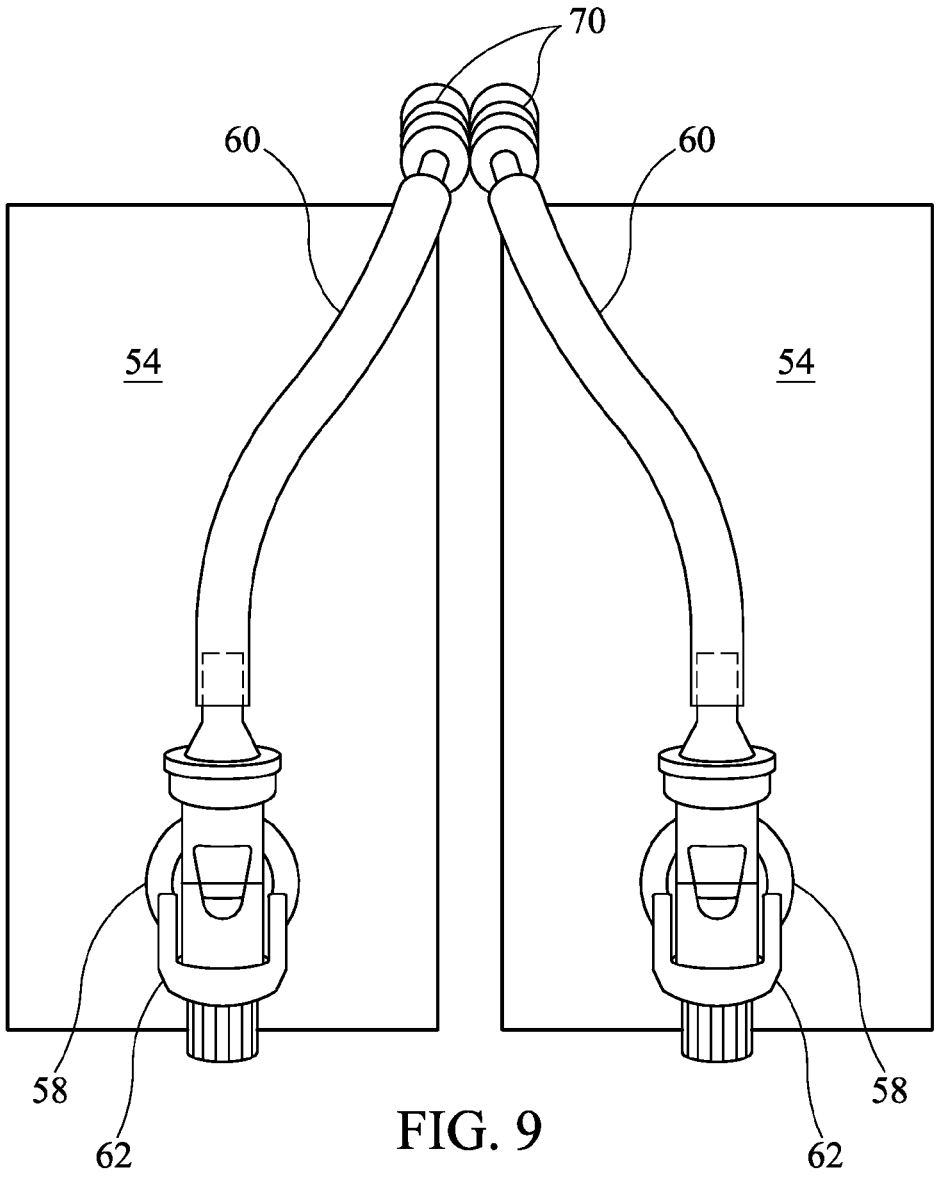
FIG. 9 is a front view of two wine containers with outlet valves and delivery hoses attached.

In the present invention, an improved connector such as, but not limited to, the improved connector disclosed in my co-pending patent application 61/438,500, filed Feb. 1, 2011, overcomes this problem. Referring to FIGS. 8 and 9, wine container 54 comprises a box which may be formed of cardboard or other conventional material. This box will be installed inside the refrigerated wine storage compartment 22. A box outlet fitting 58 is mounted in the side of the box. Outlet fitting 58 attaches to a connector 62 on a delivery hose 60 to form a right angle connection, such that wine flows out of the box and then turns at a right angle in fitting 58. The wine dispenser is connected to box 54 by a delivery hose 60 that has a connector 62 on the end. The connection between delivery hose 60 and the internal hosing in the cabinet incorporates a check valve 70 to prevent wine from flowing backward, out of the cabinet, and to prevent air or oxygen from entering the cabinet hosing.

Figure 10A:
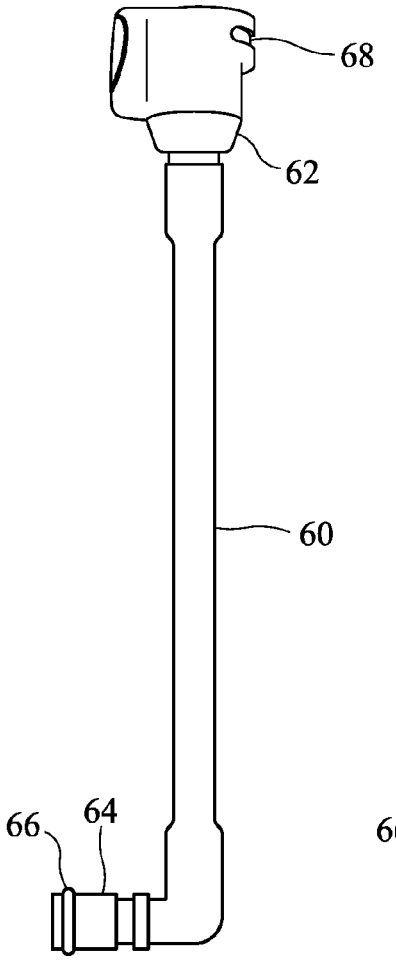
FIG. 10 is a detailed view of three embodiments of connecting valves having releasable fittings.

FIG. 10 depicts three embodiments of connectors 62 that will form a right angle attachment when connected to wine box outlet fitting 58. FIG. 10A is an embodiment in which a check valve 68 is incorporated into the connector 62. Connector 62 forms a right angle connection with wine box fitting 58, as shown in FIG. 8, and is also connected to delivery hose 60. Delivery hose 60 is a short hose that connects to other internal hoses within the wine dispensing cabinet. As shown in FIG. 10, delivery hoses 60 may have different connectors 62 at one end where connections are made to wine box outlet fittings 58. This permits the wine dispensing cabinet to use box wines from different wine producers having differently configured outlet fittings 58. However, delivery hoses 60 have identical fittings 64 at the end opposite the wine box connectors, where the hoses attached to the wine dispensing cabinet. Fittings 64 have an inner end connector and an O-ring seal 66 that are received into sockets in the internal hoses of the wine dispensing cabinet. Each socket has an additional check valve that is pushed opened when contacted by fitting 64. Check valve 70 prevents wine or air from backward flow through the system, and protects unused wine from oxygen deterioration. In this manner, when wine boxes are changed, no air will enter the system, and wine in boxes being removed will remain fresh and can be reinstalled at a later time with no degradation in the wine quality.

Figure 10B:
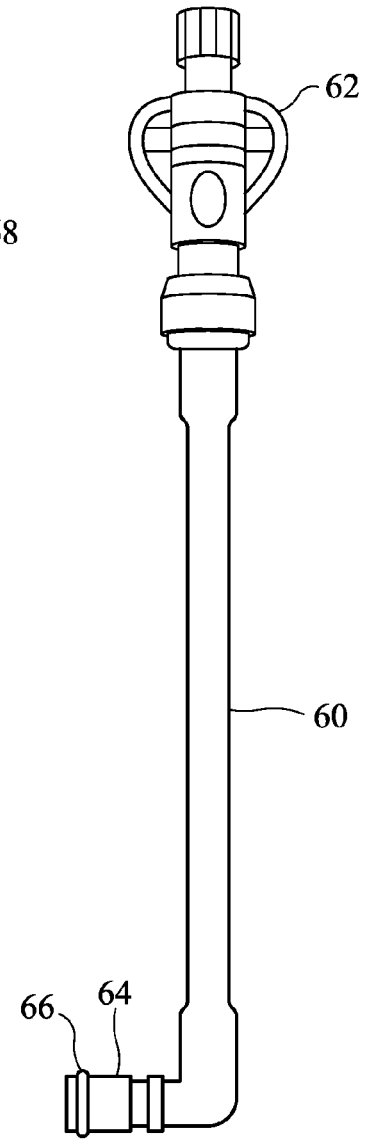
Figure 10C:
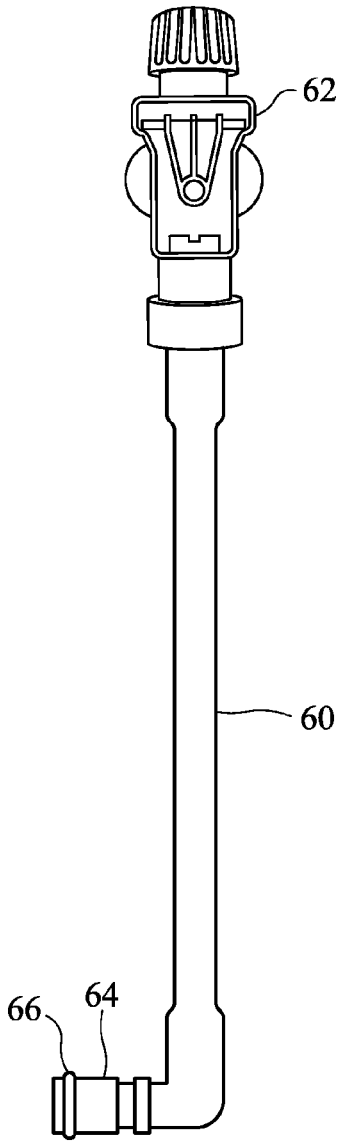

FIGS. 10B and 10C depict industry-standard connectors that interface with wine box outlet fittings 58. All connectors form a connection that is at right angles to the box outlet fitting 58, thereby relieving stress on wine box outlet fitting 58 to avoid pushing it backwards into the box during installation.

Another feature of the wine box container of the present invention is that the container is especially resistant to oxygen infiltration and therefore is able to preserve wine for up to twelve months. Check valves permit wine to be withdrawn from the container by vacuum, and prohibit the infiltration of oxygen into the flexible container. Check valves placed in the outlet fitting of the flexible container of the wine box permit the positive displacement pump to withdraw wine from the box and collapse the flexible container by applying an vacuum when wine is being dispensed. However, if the vacuum is discontinued, the check valve closes, and no oxygen will enter the container.

Another feature that makes the wine container of the present invention less permeable is the application of an oxygen resistant coating to the flexible container, which is usually a plastic bag. The oxygen resistant coating is a substance commonly referred to as EVOH (Ethylene Vinyl Alcohol). This provides an oxygen barrier for improved packaging and shelf life of the wine.

In another embodiment of the present invention, the wine boxes are provided with a computer readable bar code that contains all of the relevant information about the wine contained in the box, including the identity of the wine and any other relevant information that might be desired about the wine or the customer. The bar code can be a two or three dimensional bar code, or can be any other suitable medium that can be scanned or sensed by an appropriate scanner or sensor. The wine dispenser itself includes a bar code scanner or sensor that reads the bar code whenever a box is installed in the wine dispenser. Thus, the wine dispenser knows what wine was installed, in what storage receptacle the wine is located, when installation occurred, and how much wine is contained in the box. This information is transmitted to an internal or external (or both) computer controller. The computer controller also receives input from the pumps, dispenser nozzles, or other measuring device, and thus keeps track of the amount of wine dispensed through each nozzle. The computer controls also can receive information from a credit card reader or other payment medium in order to keep track of the payments received and compare them with quantities of wine dispensed. This computer information can be made available to the onsite operator of the wine dispenser. Also, the same information can be transmitted wirelessly or in any other conventional way to an offsite control center, where the wine dispensing systems of one or many wine dispensers can be monitored.

Figure 11:
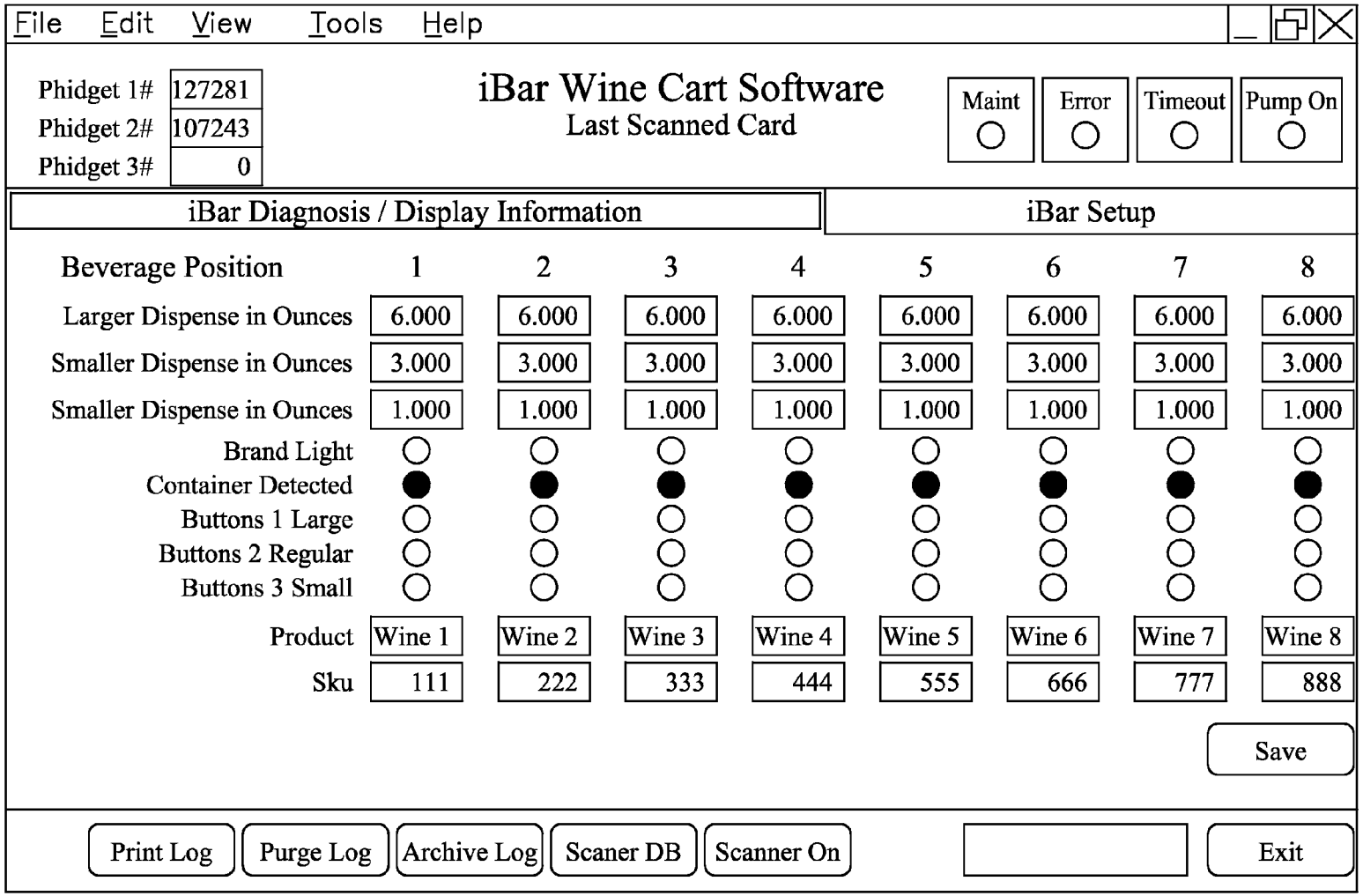
FIG. 11 is a computer monitor screen showing a beverage dispensing setup screen.

FIG. 11 depicts one embodiment of a computer display that may be attached to, or used at or near the wine dispensing cabinet to give real time information regarding the status of the cabinet. Through such an interface, pour quantities may be established, diagnostic tests may be performed, installed wine boxes may be identified, and other desired information can be monitored or modified.

Another feature of the wine box containers of the present invention is that they are larger than typically normal, holding about nine liters or one case of wine. This provides packaging and expense advantages.

In addition to monitoring operations in order to confirm that all wine dispensed has been properly accounted for, the computer monitoring operation can monitor consumer wine preferences and the amount of wine consumed and can be connected to an automatic ordering system that insures that inventory will always be on hand when needed.

These and other features of the invention have been disclosed herein. The invention, however, is not to be limited by the disclosure, as to which persons of ordinary skill in the art will perceive other options and embodiments that fall within the concept and scope of the invention, but is limited only by the appended claims.

I claim:

1. A wine dispensing cabinet for receiving a container, the cabinet comprising:

an upper housing extending above the countertop;

a plurality of compartments, at least one compartment refrigerated, each compartment including a receptacle for receiving a flexible liner for containing the wine, the liner substantially isolating the wine contained therein from oxygen by restricting the passage of oxygen through the liner, the liner including a liner connector having a first check valve, the first check valve forming a seal against the entry of oxygen into the liner and said first check valve opened by a vacuum produced by one or more peristaltic pumps drawing wine out of the liner, at least one receptacle including a sensor for identifying the liner of wine received in the at least one receptacle;

one or more dispensing nozzles provided in the upper housing, each dispensing nozzle connected with the liner connector through at least one delivery hose and an internal hose system in the cabinet in order to dispense wine from the at least one liner of wine into the container when the container is received and positioned under the dispensing nozzle, the delivery hose connectable with the liner connector at a first end of the delivery hose, the delivery hose coupleable with the internal hose system in the cabinet at the end of the delivery hose opposite the first end, the delivery hose including a fitting at the end of the delivery hose opposite the first end;

a hose connector for coupling the delivery hose with the internal hosing system, the hose connector including a second check valve in order to prevent the oxygen from entering the internal hose system;

a processor electrically connected with the one or more peristaltic pumps as well as the sensor, the processor controlled by one or more wine selection buttons provided on the wine dispensing cabinet, the processor operable to send an electric signal to the one or more peristaltic pumps in order to dispense a variable quantity of wine, as selected by the one or more wine selection buttons, contained in one of the liners of wine into the wine glass when received and positioned under the dispensing nozzle, the processor further operable to calculate the quantity of wine pumped from each received liner of wine, the processor further operable to identify the liner received in each receptacle and calculate the quantity of wine remaining in each received wine liner after the variable quantity of wine is dispensed.

2. The wine dispensing cabinet of claim 1, wherein the liner connector forms a right angle connection with the delivery hose.

3. The wine dispensing cabinet of claim 1 wherein the quantity of wine pumped is calculated by the amount of time the one or more peristaltic pumps are operated.

4. The wine dispensing cabinet of claim 1 further comprising a database connected with the processor, the database operable to store information data including one or more of the following: the quantity of wine remaining in each received wine liner; identification of the liner received in the receptacle; identification of empty receptacles; and age of an individual for whom wine is dispensed to.

5. The wine dispensing cabinet of claim 4, further comprising a display panel operable to display the information data.

6. The wine dispensing cabinet of claim 5, wherein the display panel is located a location remote from the wine dispensing cabinet.

7. The wine dispensing cabinet of claim 4, wherein the processor is connected to a remote processor, and the processor is operable to send the information data to the remote processor.

8. The wine dispensing cabinet of claim 1, wherein the processor is further operable to detect when the liner contains less than a predetermined amount of wine and, once the liner contains less than the predetermined amount, to no longer send the electronic signal to the one or more peristaltic pumps.

9. The wine dispensing cabinet of claim 1, wherein the cabinet has at least eight compartments for receiving the flexible liner, the flexible liner dimensioned to hold at least nine liters of wine, and the cabinet further comprises a plurality of rollers attached to the base of cabinet in order to permit the entire cabinet to move and swivel.

10. The wine dispensing cabinet of claim 1, wherein at least a portion of the liner is coated with an oxygen resistant coating.

11. A wine dispensing cabinet for dispensing wine into a container, the cabinet comprising:

a compartment including a receptacle for receiving a flexible liner for containing the wine, the liner substantially isolating the wine contained therein from oxygen by restricting the passage of oxygen through the liner, the liner including a liner connector having a first check valve, the first check valve forming a seal against the entry of oxygen into the liner and said first check valve opened by a vacuum produced by one or more peristaltic pumps drawing wine out of the liner;

one or more dispensing nozzles provided in a housing, each dispensing nozzle connected with the liner connector through at least one delivery hose and an internal hose system in the cabinet in order to dispense wine from the at least one liner of wine into the container when the container is received and positioned under the dispensing nozzle, the delivery hose connectable with the liner connector at a first end of the delivery hose, the delivery hose coupleable with the internal hose system in the cabinet at the end of the delivery hose opposite the first end, the delivery hose including a fitting at the end of the delivery hose opposite the first end;

a hose connector for coupling the delivery hose with the internal hosing system, the hose connector including a second check valve in order to prevent the oxygen from entering the internal hose system;

a processor electrically connected with the one or more peristaltic pumps, the processor controlled by one or more wine selection buttons provided on the wine dispensing cabinet, the processor operable to send an electric signal to the one or more peristaltic pumps in order to dispense a variable quantity of wine, as selected by the one or more wine selection buttons, contained in one of the liners of wine into the wine glass when received and positioned under the dispensing nozzle, the processor further operable to calculate the quantity of wine pumped from each received liner of wine, the processor further operable to identify the liner received in each receptacle and calculate the quantity of wine remaining in each received wine liner after the variable quantity of wine is dispensed.

12. The wine dispensing cabinet of claim 11, wherein the liner connector forms a right angle connection with the delivery hose.

13. The wine dispensing cabinet of claim 11 further comprising a database connected with the processor, the database operable to store information data including one or more of the following: the quantity of wine remaining in each received wine liner; identification of the liner received in the receptacle; identification of empty receptacles; and age of an individual for whom wine is dispensed to.

14. The wine dispensing cabinet of claim 13, further comprising a display panel for operating the wine dispensing cabinet or to display the information data.

15. The wine dispensing cabinet of claim 14, wherein the display panel is located a location remote from the wine dispensing cabinet.

16. The wine dispensing cabinet of claim 15, wherein the processor is connected to a remote processor, and the processor is operable to send the information data to the remote processor.

17. The wine dispensing cabinet of claim 11, wherein at least a portion of the liner is coated with an oxygen resistant coating.

18. The wine dispensing cabinet of claim 11, wherein the compartment is refrigerated.

* * * * *